US008973347B2

(12) United States Patent
Headland et al.

(10) Patent No.: US 8,973,347 B2
(45) Date of Patent: Mar. 10, 2015

(54) PILOT BURNER OF A GAS TURBINE ENGINE, COMBUSTOR, AND GAS TURBINE ENGINE

(75) Inventors: Paul Headland, Lincoln (GB); Michael Turnbull, Broughton (GB)

(73) Assignee: Siemens Aktiengesellschaft, München (DE)

( * ) Notice: Subject to any disclaimer, the term of this patent is extended or adjusted under 35 U.S.C. 154(b) by 1136 days.

(21) Appl. No.: 12/955,994

(22) Filed: Nov. 30, 2010

(65) Prior Publication Data

US 2011/0126509 A1 Jun. 2, 2011

(30) Foreign Application Priority Data

Dec. 1, 2009 (EP) ..... 09014908

(51) Int. Cl.

| | |
|---|---|
| ***F23R 3/00*** | (2006.01) |
| ***F23R 3/34*** | (2006.01) |
| ***F23D 11/38*** | (2006.01) |
| ***F23R 3/28*** | (2006.01) |

(52) U.S. Cl.

CPC ..... *F23R 3/343* (2013.01); *F23D 11/38* (2013.01); *F23R 3/28* (2013.01); *F23D 2900/00015* (2013.01); *F23D 2900/00018* (2013.01); *F23R 2900/00005* (2013.01); *F23R 2900/00018* (2013.01)

USPC ..... 60/39.826; 60/740

(58) Field of Classification Search

CPC .. F23R 2900/00005; F23R 3/28; F23R 3/343; F23D 2900/00015; F23D 2900/00016; F23D 2900/00018

USPC ..... 60/39.37, 39.826, 740, 742; 431/159, 431/196, 354

See application file for complete search history.

(56) References Cited

U.S. PATENT DOCUMENTS

| | | | | |
|---|---|---|---|---|
| 4,373,896 | A | 2/1983 | Zwick et al. | |
| 6,151,899 | A * | 11/2000 | Park | 60/748 |
| 2002/0178727 | A1 | 12/2002 | Halila et al. | |
| 2005/0016178 | A1 * | 1/2005 | Wasif et al. | 60/752 |
| 2007/0205189 | A1 | 9/2007 | Miller | |
| 2009/0111063 | A1 | 4/2009 | Boardman et al. | |

FOREIGN PATENT DOCUMENTS

| | | | |
|---|---|---|---|
| DE | 10 2008 006 572 | A1 | 7/2009 |
| EP | 0 845 634 | A2 | 6/1998 |
| EP | 1442163 | A1 | 8/2004 |
| EP | 2108476 | A1 | 10/2009 |
| FR | 2669846 | A1 | 6/1992 |

(Continued)

OTHER PUBLICATIONS

Bill Gunston, Cambridge Aerospace Dictionary, 2009, Cambridge University Press, 2nd Edition, p. 115.*

*Primary Examiner* — Phutthiwat Wongwian
*Assistant Examiner* — Marc J Amar

(57) ABSTRACT

A pilot burner of a gas turbine engine is provided. The pilot burner includes a front body with an axial expansion along a center axis of the pilot burner, the center axis having an axial direction towards a burning zone of the gas turbine engine. The front body includes a pilot burner face which is directed to the burning zone. A material is deposited in the front body progressing in the axial direction to form a high temperature resilient body in the axial direction of the front body and to form a high temperature resilient face of the pilot burner face.

20 Claims, 2 Drawing Sheets

(56) References Cited

FOREIGN PATENT DOCUMENTS

| | | | |
|---|---|---|---|
| JP | 2006320907 | A | 11/2006 |
| WO | WO 00/07713 | A1 | 2/2000 |
| WO | WO 2006025865 | A2 | 3/2006 |
| WO | WO 2009/029399 | A1 | 3/2009 |
| WO | WO 2009/126701 | A2 | 10/2009 |
| WO | WO 2009126701 | A2 * | 10/2009 |

* cited by examiner

PILOT BURNER OF A GAS TURBINE ENGINE, COMBUSTOR, AND GAS TURBINE ENGINE

CROSS REFERENCE TO RELATED APPLICATIONS

This application claims priority of European Patent Office application No. 09014908.9 EP filed Dec. 1, 2009, which is incorporated by reference herein in its entirety.

FIELD OF INVENTION

The present invention relates to a pilot burner of a gas turbine engine with a pilot burner face which is directed to the burning zone of the gas turbine engine.

BACKGROUND OF INVENTION

Pilot burners are used in gas turbine engines to ignite a fuel/air mixture, in particular to ignite a mixture of liquid fuel and/or gas fuel with air, in the burning zone, which is directed afterwards the pilot burner, i.e. downstream. The fuel and the air are mixed together in a swirling zone and are ignited in the burning zone of the pilot burner to create a high-energy fluid flow to propel a turbine section of the gas turbine engine.

Current designs of burner are made of austenitic stainless steel, which possesses good resistance to scaling at high temperatures and which can be used for continuous high temperature operation. Austenitic stainless steel is a compromise material to keep the costs of the pilot burner down and to provide good resistance to the temperature.

But because of the excessive stresses induced by the temperature gradients during engine operation this design of pilot burner, in particular of the pilot burner face, is susceptible to cracking and thereby reducing pilot burner life.

Therefore it is known to provide the face of the pilot burner with a MCrAlY coating to reduce oxidation attack and to keep the metal temperature in the pilot burner within acceptable limits for component life. MCrAlY is an acronym for a composition of metal ("M" stands for Ni, Co, or Fe base or mixtures thereof), Chromium ("Cr"), Aluminum ("Al"), and Yttrium ("Y").

But the coating on a pilot burner face has some disadvantages. The coating is often not thick enough to give a good protection from high temperatures, especially over a long time.

SUMMARY OF INVENTION

It is therefore an object of the present invention to provide a pilot burner for a gas turbine engine which is resilient to high temperatures with the aim that the pilot burner should have a long lifespan.

The object of the invention is solved by a pilot burner with the features according to the claims and by a combustor and a gas turbine engine comprising such a pilot burner according to the further independent claims. Advantages, features, details, aspects and effects of the invention arise from the dependent claims, the description and the figures.

According to the invention a pilot burner of a gas turbine engine is provided comprising a front body with an axial expansion along a centre axis of the pilot burner, the centre axis having an axial direction towards a burning zone of the gas turbine engine, and the front body comprising a pilot burner face which is directed to the burning zone. The pilot burner is characterised in that a material—particularly a noncoating material—is deposited in the front body progressing in axial direction to form a high temperature resilient body in axial direction of the front body and to form a high temperature resilient face of the pilot burner face.

Instead of a coating on the surface of the pilot burner the material is placed in the hot section of the pilot burner replacing a coating or supporting an optional further coating, such that the heat can not affect the pilot burner. This can be achieved by using a high temperature resilient material to form a high temperature resilient body within the front body, with an axial expanse being a magnitude larger than the thickness of a coating. The material is spread in radial direction like a coating to provide a high temperature resilient pilot burner face but is also extending in axial direction so that it provides the necessary thickness for heat protecting the remaining body of the pilot burner.

In a preferred embodiment the material is deposited to build a disk of high temperature resilient material in a recess—a blind hole—of the pilot burner face.

In the sense of the invention the pilot burner face is the end part of the pilot burner which is directed to the burning zone of the pilot burner or the swirling zone for mixing the fuel and air, together. To give a strong hold the material is deposited into the specific recess in the pilot burner face. This has several advantages. First, the dimensions of the pilot burner do not increase. Further, the recess and therefore the disk can have a sufficient thickness to give a long time protection to the pilot burner. The thickness of the recess can vary according to the operational field. The existence of a disk of a high temperature resilient material in the recess of the pilot burner face reduces the occurrence of hot gas leakages to atmosphere, which again improves the safety of the pilot burner. Furthermore, the reparability of the pilot burner is improved. Once component life of the disk has been achieved the disk can be removed—e.g. machined out—and a new material can be applied to the recess in the pilot burner face. Therefore, the component life of the pilot burner can be increased depositing high temperature resilient material in the recess of the pilot burner face.

Advantageously the disk is placed form-shaped into the recess of the pilot burner face.

A high temperature resilient material is in the sense of the invention a material which can resist high thermal stresses, in particular in a temperature range of 850°-1500° C. (Celsius). Therefore, according to a very suitable development of the invention the material of the disk of the pilot burner face is temperature resilient to temperatures over 1000° C., in particular to temperatures up to 1500° C. or more. Preferred is a pilot burner, whereby the material of the disk is a high temperature resilient metal or high temperature resilient metal alloy, in particular comprising aluminium and/or nickel.

Having a deposited disk in the pilot burner face, the main body of the pilot burner can be made of an austenitic stainless steel. The costs of such a pilot burner can be kept down, because only a limited amount of the specific high temperature resilient material is needed to fill the recess. The remaining pilot burner body may be composed of a different, less costly, material.

Further, a pilot burner is preferred, whereby the disk of high temperature resilient metal is being deposited, in particular laser deposited, into the recess of the pilot burner face. That means the disk can be made by a laser deposition method. Laser deposition or pulsed laser deposition is a thin film deposition technique where a high power pulsed laser beam is focused inside a vacuum chamber to strike a target of a desired composition. Thereby material is vaporized from the target and deposited as disk in the recess of the pilot burner face. The material may be applied by several layers to fill the recess. Such a disk or such a pilot burner face is very heat resistant. The advantage of depositing the material in the recess is the strong hold of the disk within the recess after the material is hardened. The laser deposited disk has in contrast to a simple coating a very strong hold within the recess. Further the disk is better protected, because of the deposition in the recess, than a simple coating on the surface of a planar pilot burner face.

In a further very preferred embodiment the high temperature resilient disk is being deposited into the recess by way of hot metal spraying or cold metal spraying. The metal for building the disk can be deposited by hot metal spraying or by the use of cold metal spraying which have the advantage of building up a compressive stress layer or disk in the recess of the pilot burner face thereby helping to resist the thermal stresses on the main body of the pilot burner. The metal which is sprayed into the recess in the pilot burner face hardens after a while and builds a plate, the disk, with the thickness of the recess. The whole recess is being filled up with high temperature resilient material, in particular with high temperature resilient metal.

Hot metal spraying is the process of spraying molten metal into the recess to form a disk of a sufficient thickness. This is achieved by melting either pure or alloyed metals in a flame or an arc. The molten metal is then subjected to a blast of compressed air which has the joint effect of creating tiny droplets of metal and projecting them towards the recess. The end result is a solid metal disk in the recess. The thickness of the disk is dictated by the number of layers applied. Advantageously aluminium or zinc is deposited by way of hot metal spraying to the material, in particular the steel, of the pilot burner. This is in particular advantageously because of the high temperature resistance of these materials.

All methods of metal spraying, like arc spraying or flame spraying, involve the projection of small molten particles into the recess, where they adhere and form the continuous disk. To create the molten particles, a heat source, a spray material and an atomization/projection method are required. Upon contact, the particles flatten into the recess, freeze and mechanically bond. Firstly onto the possibly roughened bottom of the recess and then onto each other as the disk thickness is increased.

Cold spraying involves injecting microscopic powdered particles of metal or other solids into a supersonic jet of rapidly expanding gas and shooting them into the recess of the pilot burner face. When these particles collide with the bottom of the recess they stick and form the disk.

Cold spraying is called room-temperature spraying, as well. Conventional hot or thermal spray processes require preheating of the sprayed materials so the particles are in a semi-molten state when they reach the ground of the recess in the pilot burner face. This allows them to splash across the surface of the recess. But as the particles cool, they contract slightly, creating residual stresses or flaws at the interface that can cause defects later. By contrast, cold sprayed materials typically remain at, or near, room temperature until impact, slamming into the substrate so fast, approximately with 500 to 1,500 m/s, that a tight bond is formed without the undesirable chemical changes and stresses associated with conventional processes. Unlike thermal-sprayed materials, cold-sprayed materials experience little to no defect-causing oxidation during flight and exhibit remarkably high densities and conductivities once fabricated. In addition, deposition rates comparable to traditional thermal spray processes can be achieved by a cold spraying method. Light gases such as nitrogen and helium are preferred due to their low molecular weight. This means their sonic velocity is as high as possible. Cold spraying has the advantage that it can be carried out at atmospheric pressure. Other processes require lower pressures such as vacuum to achieve similar quality coatings.

Ideally, powders should have a material as fine as possible, with the low end being defined by the fact that when this supersonic gas stream hits the recess surface, a shockwave forms on the surface. Particles in the 5-15 micron (micrometer) range are optimal, although, some materials up to as high as 30 microns and more still give good results. The problem of particles below 5 microns is that they will follow the gas flow and decelerate near the ground of the recess.

It is possible to spray different material in the recess to build a disk. For example, disks out of alumina materials and/or nickel are very high temperature resilient and have extremely low heat absorption. Further, these materials are thermal shock resistant and possess a good protection against corrosion.

The shape of the recess can be different. The recess may have a rectangular, an oval or a triangular shape, for example, as seen from the direction of the burning zone. Preferably the shape of the recess in the pilot burner face may be circular shaped. The pilot burner face may have typically a circular shape. A circular shaped disk in a circular shaped recess can cover up nearly the complete pilot burner face. Advantageously the recess is as big as possible so that nearly the complete front face of the pilot burner is protected by the high temperature resilient disk.

In a very preferred embodiment of the pilot burner the cross-section of the recess is decreasing in direction to the burning zone of the gas turbine engine. That means the disk is absolutely fixed in the recess after the sprayed metal is hardened. The disk is form-shaped fixed within the recess. Basically the disk then has the form of a truncated cone.

Other forms may be advantageous, e.g. the recess may be a cavity substantially in form of a cylinder, or of a cone for which the base of the cone is the pilot burner face, particularly a concave cone. Besides, the recess may be a hemisphere or of a truncated cone, the latter having a decreasing cross section in axial direction towards the pilot burner face. The deposited material will substantially form an opposing body, because it is fitted into the recess.

The recess may have a circular shaped rim at the pilot burner face. Radially inwards of that rim the material is deposited to build the high temperature resilient front body. The deposited may be perfectly end in the same plane as a surrounding—radial outwards—front face surface of the pilot burner face. To gain a perfect flat surface, still an additional coating may be applied to the complete front face. Alternatively the deposited may also "overflow" the rim and will cover the complete front face.

Previously an embodiment was described in which a solid front body may have a recess into which material is deposited. Alternatively the complete front body itself can be built up by depositing material. Material may be sprayed layer by layer to add material to a core pilot burner body so that finally a front body is created by deposition. This is specifically advantageous if the chemical composition may be changed during the spraying or deposition of the material or if two different materials get mixed and commonly applied to the surface and that the concentration of the applied materials change. With that a sliding scale between the two materials or between the two chemical compositions may be gained.

Specifically the composition of the deposited material may be altered, particularly gradually, in a radial direction perpendicular to the centre axis such as a higher concentration of heat resistant material is deposited near the centre axis. Additionally or alternatively, the composition of the deposited material may be altered, particularly gradually, in axial direction such as a higher concentration of heat resistant material is deposited near the pilot burner face.

With that it is possible to have a higher concentration of heat resistant material in an area which will need better protection against heat, whereas in an area further radial outwards or further away from the burning zone, the front body may be comprised with a higher concentration of a less heat resistant material. Advantageously this may result in areas within the front body in which equi-concentration or equi-composition of the deposited material will substantially form a cone, particularly a concave cone, or a hemisphere, or a truncated cone.

With "equi-concentration" a three-dimensional region is defined in which the same concentration between the two deposited materials is present. With "equi-composition" a three-dimensional region is defined in which the same chemical composition is present for the deposited materials.

The advantages of such a pilot burner are the improved component life of the pilot burner, the reduction in the occurrence of hot gas leakage to atmosphere and therefore the improved safety, and the increased reparability of the pilot burner. When the deposited material has achieved the end of its life cycle the disk can be machined out and a new material can re-applied into the recess or to the body of the pilot burner. The main body of the burner is still operable when the deposited material is no longer able to perfectly protect the main body. Applying new material allows the pilot burner body to be reused, thereby increasing the life of the pilot burner. Furthermore, no scraping off of the pilot burner body is required by depositing material into a recess in the pilot burner face.

Even though the invention is described as a definition of a pilot burner, also a method of depositing material to a pilot burner body could be defined, leading to the claimed pilot burner.

BRIEF DESCRIPTION OF THE DRAWINGS

In the following the invention is described again in detail with respect to the attached figures, wherein.

DETAILED DESCRIPTION OF INVENTION

Figure 1:
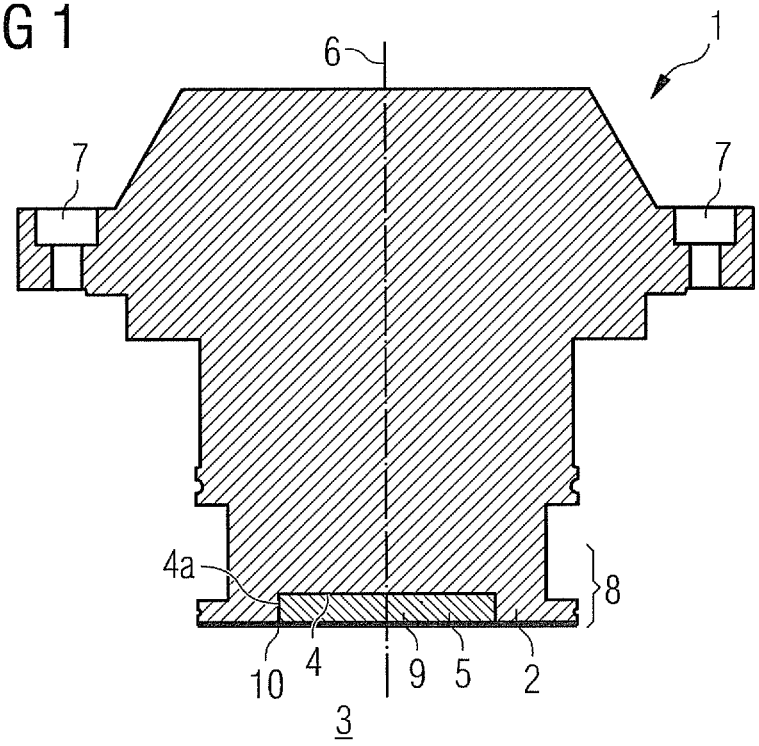
FIG. 1 shows a longitudinal section through a first embodiment of a pilot burner with an inventive disk deposited in the pilot burner front body.

FIG. 1 shows schematically a longitudinal section through a first embodiment of a pilot burner 1 with a deposited disk 5 in a front body 8 of the pilot burner, ending at a pilot burner face 2. The disk 5 protects the pilot burner 1 against the heat in a burning zone 3, being a high temperature resilient body. Because of the susceptibility of the pilot burner face 2 to excessive heat during engine operation and the danger of cracks, oxidation and hot air leakage to atmosphere the disk 5 is deposited in a substantially cylindrical recess 4 in the pilot burner face 2. The disk 5 comprises a temperature resilient metal which is much more temperature resilient than the material of the pilot burner 1 and the pilot burner face 2, respectively. To keep the costs down the pilot burner 1 can be made out of an austenitic stainless steel, which possesses good resistance to scaling at high temperatures and which can be used for continuous high temperature service in the range 850°-1000° C. This is a compromise material to keep the costs of the pilot burner 1 down and to provide some resistance to the temperature. Only the disk 5 may be made out of a high temperature resilient material, which can be used for continuous high temperature service in the range of 1000° C.-1500° C., better in a range of 1000° C.-2000° C.

A rim 10 of the recess 4, the rim 10 defining a connection between a first material of the burner 1 and the deposited material 9, in this embodiment of the pilot burner 1 is circular shaped whereby the side walls 4*a* of the recess 4 run parallel to the longitudinal axis 6—the axis of symmetry for most parts of the pilot burner 1, also considered as centre axis—of the pilot burner 1. The recess 4 is basically in form of cylindrical blind hole. Advantageously the disk 5—a cylinder with short height compared to its radius—is built from the deposited material 9 deposited into the recess 4 by hot metal spraying or cold metal spraying. The metal could be deposited by hot metal spraying or by use of cold metal spraying which have the advantage of building up a compressive stress layer in the pilot burner face 2 thereby helping to resist the thermal stresses of the pilot burner. One of the advantages of the disk of high temperature resilient material within the recess 4 of the pilot burner face 2 is that it protects the pilot burner 1 against excessive heat and therefore improves the pilot burners 1 durability. Further, the disk 5 in the recess 4 of the pilot burner face 2 reduces the occurrence of hot gas leakage to atmosphere and improves safety. The specific embodiment of the pilot burner face 2 increases the reparability of the pilot burner 1, as well. Once end of lifetime of the disk 5 has been reached the deposited disk, i.e. the rest of the deposited material, can be machined out and another disk 5 can be re-applied by depositing material into the recess 4. Therefore no scraping off of the pilot burner 1 body is required.

Figure 2:
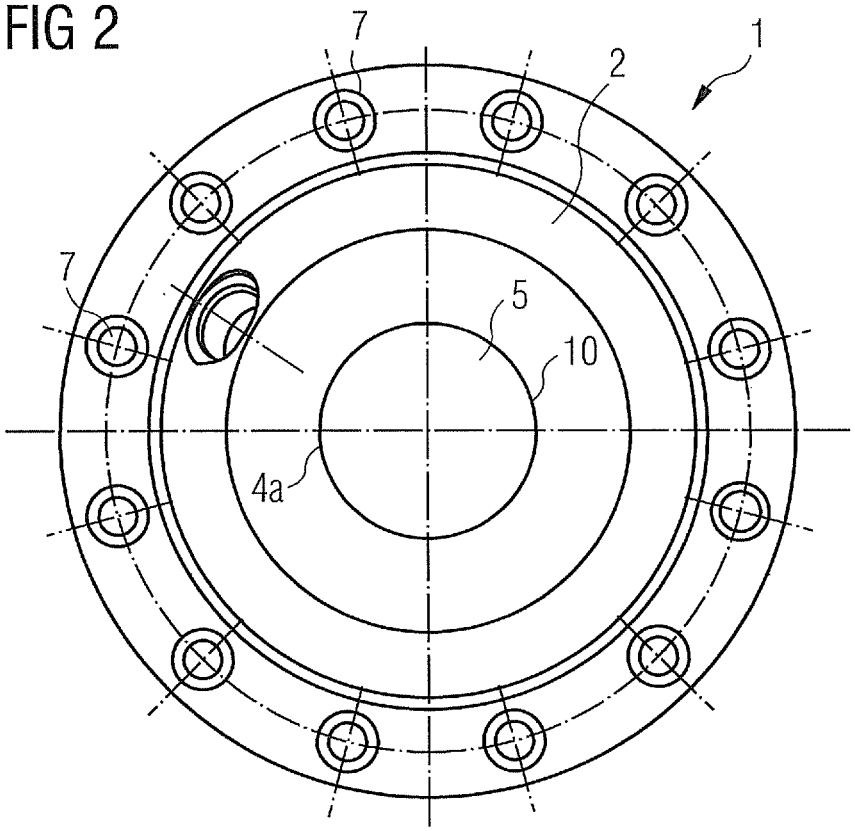
FIG. 2 shows schematic a view of a pilot burner from a direction of a burning zone with an inventive disk deposited in the pilot burner front body, according to FIG. 1.

FIG. 2 shows a schematic view from below to the embodiment of a pilot burner 1 with an inventive disk 5 in the pilot burner face 2 according to FIG. 1. In other words, FIG. 2 shows the pilot burner 1 as seen from the direction of the burning zone 3. The disk 5 is arranged in the centre of the pilot burner face 2. The circular rim 10 is visible as the most central circle in the figure. The disk 5 is shaped circular, but can be shaped in any other form, as well. The pilot burner 1 has a couple of bore holes 7 to fix the pilot burner 1 to a main fuel feed inlet, for example.

Figure 3:
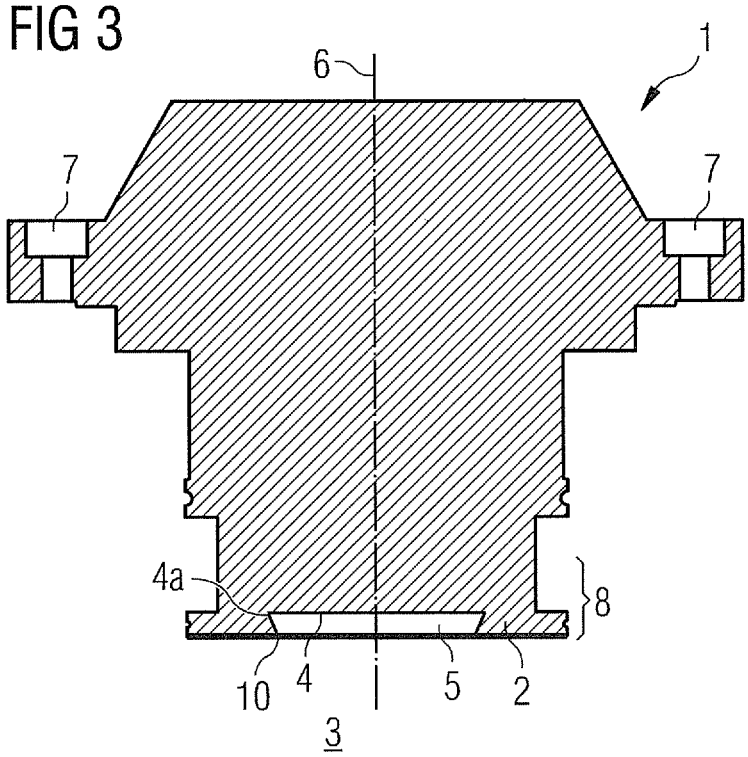
FIG. 3 shows a longitudinal section through a second embodiment of a pilot burner with an inventive disk deposited in the pilot burner front body.

FIG. 3 shows a schematic longitudinal section through a second embodiment of a pilot burner 1 with a differently formed recess 4 in the pilot burner face 2. The only difference to the pilot burner 1 shown in FIG. 1 lies is the form of the recess 4 in the pilot burner face 2. In contrast to the recess 4 shown in FIG. 1 the recess of this embodiment has inclined side walls 4*a*, whereby the cross-section of the recess 4 is decreasing in direction to the burning zone 3 of the gas turbine engine. The deposited material 9 substantially in form of disk 5 in the recess 4 has a very strong hold.

Figure 4:
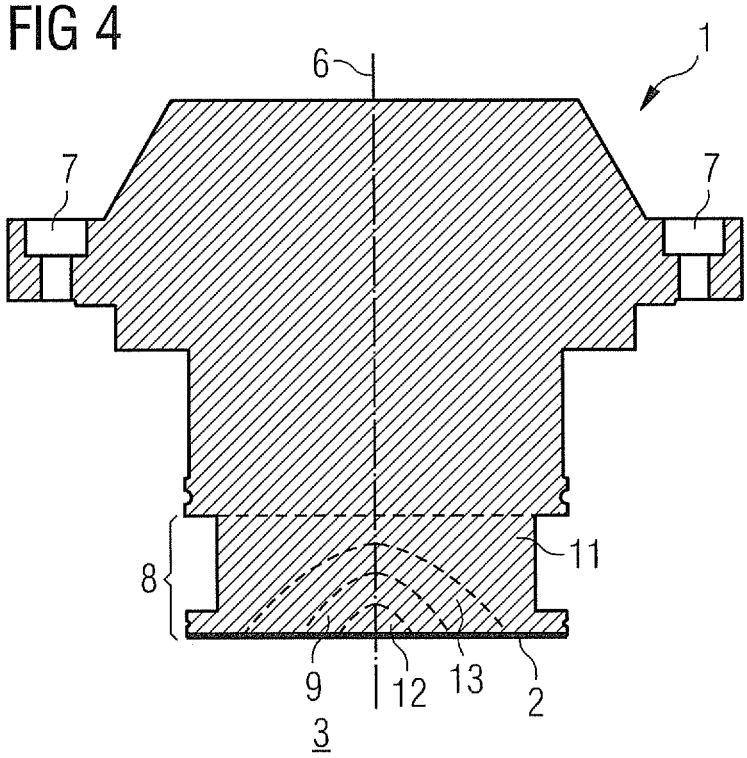
FIG. 4 shows a longitudinal section through a third embodiment of a pilot burner with a gradual change of materials deposited in the pilot burner front body.

FIG. 4 shows a schematic longitudinal section through a second embodiment of a pilot burner 1 without using a recess but by building up the front body 8 of the pilot burner 1, by depositing at least two different materials. There may be regions in which only a first, less heat resistant, material get deposited—in a first region 11—, for example areas facing away from the burning zone 3. There may be regions in which only a second, improved heat resistant, material get deposited—in a second region 12—, for example areas close to the pilot burner face 2. The second region 12 is considered a high temperature resilient body, according to the invention. Besides there may be regions in which both the first material and the second material get deposited in which the deposited material 9 may be a mixture of both materials—in a third region 13.

According to the embodiment of FIG. 4, the concentration between the two materials will gradually be changed based on the radial and axial depositing position. Advantageously this will result in hemispherical or conical distribution of the materials as indicated by dashed lines in the figure.

With this embodiment, it is possible to build one homogeneous solid front body 8. The gradual change the concentration or composition between the two materials allows to precisely create areas with the exact "amount" of heat resistance as needed for that area. With that principle it can easily be achieved that the whole pilot burner face 2 will be composed of a very heat resistant material without applying a coating.

For all embodiments it has to be pointed out that the deposition of material according to the invention is not a coating operation. A metal powder is applied, e.g. sprayed. The effective width of the deposited material is larger than a width of a mere coating. Also different materials are being used, especially not MCrAlY which is widely used for coatings.

The invention claimed is:

1. A pilot burner of a gas turbine engine, comprising:

a front body with an axial expansion along a centre axis of the pilot burner, comprising:

a pilot burner face forming a front end of a burning zone, wherein the centre axis includes an axial direction towards the burning zone of the gas turbine engine, wherein the pilot burner face is directed to the burning zone, and wherein a material is deposited on the pilot burner face of the front body progressing in the axial direction toward the burning zone to form a high temperature resilient body in the axial direction of the front body and to form a high temperature resilient face of the pilot burner face, wherein the deposited material is more temperature resilient than the material of the pilot burner and the pilot burner face.

2. The pilot burner according to claim 1, wherein the pilot burner face of the front body further comprises a recess in which the material is deposited so as to fill the recess to form the high temperature resilient body and the high temperature resilient face.

3. The pilot burner according to claim 1, wherein a composition of the deposited material is altered in a radial direction perpendicular to the centre axis such as a higher concentration of heat resistant material is deposited near the centre axis and/or the deposited material is altered in the axial direction such as a higher concentration of heat resistant material is deposited near the pilot burner face.

4. The pilot burner according to claim 3, wherein the deposited material is altered gradually.

5. The pilot burner according to claim 3, wherein the deposited material is a metal or a metal alloy and wherein a composition of the metal or metal alloy is altered based on a radial depositing position and/or an axial depositing position.

6. The pilot burner according to claim 3, wherein a plurality of areas within the front body having the same composition or same concentration of the deposited material will substantially form a cylindrical disk, or a cone, or a hemisphere, or a truncated cone.

7. The pilot burner according to claim 6, wherein the cone formed is a concave cone.

8. The pilot burner according to claim 2, wherein the recess is formed substantially symmetric around the centre axis, and wherein the recess includes an axial direction along the centre axis in a direction to the burning zone and a radial direction starting at the centre axis and in a plane perpendicular to the centre axis.

9. The pilot burner according to claim 2, wherein the recess comprises a circular shaped rim.

10. The pilot burner according to claim 2, wherein the recess is a cavity substantially in form of a cylinder, or of a cone, or of a hemisphere, or of a truncated cone and/or the deposited material will substantially form a cylindrical disk, or a cone, or a hemisphere, or a truncated cone.

11. The pilot burner according to claim 10, wherein the cone is a concave cone.

12. The pilot burner according to claim 1, wherein the deposited material is a high temperature resilient metal or metal alloy, and is temperature resilient to temperatures over 1000° C.

13. The pilot burner according to claim 12, wherein the metal alloy comprises aluminium or nickel.

14. The pilot burner according to claim 12, wherein the deposited material is temperature resilient to temperatures up to 1500° Celsius or more.

15. The pilot burner according to claim 1, wherein the deposited material is laser deposited.

16. The pilot burner according to claim 1, wherein the deposited material is deposited using of hot metal spraying or cold metal spraying.

17. The pilot burner according to claim 1, wherein the deposited material is deposited as a plurality of layers of the material.

18. The pilot burner according to claim 17, wherein the deposited material is a metal or a metal alloy and wherein a composition of the metal or metal alloy is different between two adjacent layers of the plurality of layers of the deposited material.

19. A combustor of a gas turbine engine, comprising:

pilot burner, comprising:

a front body with an axial expansion along a centre axis of the pilot burner, comprising:

a pilot burner face forming a front end of a burning zone, wherein the centre axis includes an axial direction towards the burning zone of the gas turbine engine, wherein the pilot burner face is directed to the burning zone, and wherein a material is deposited on the pilot burner face of the front body progressing in the axial direction toward the burning zone to form a high temperature resilient body in the axial direction of the front body and to form a high temperature resilient face of the pilot burner face, wherein the deposited material is more temperature resilient than the material of the pilot burner and the pilot burner face.

20. A gas turbine engine, comprising:

a pilot burner, the pilot burner comprising:

a front body with an axial expansion along a centre axis of the pilot burner, comprising:

a pilot burner face forming a front end of a burning zone, wherein the centre axis includes an axial direction towards the burning zone of the gas turbine engine, wherein the pilot burner face is directed to the burning zone, and wherein a material is deposited on the pilot burner face of the front body progressing in the axial direction toward the burning zone to form a high temperature resilient body in the axial direction of the front body and to form a high temperature resilient face of the pilot burner face, wherein the deposited material is more temperature resilient than the material of the pilot burner and the pilot burner face.

* * * * *